US007297883B2

(12) United States Patent
Rochon et al.

(10) Patent No.: US 7,297,883 B2
(45) Date of Patent: Nov. 20, 2007

(54) ELECTRICAL SWITCH WITH MULTIPLE SWITCHING WAYS

(75) Inventors: Sylvain Rochon, Dole (FR); Michel Bruno, Dole (FR)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 13 days.

(21) Appl. No.: 11/283,010

(22) Filed: Nov. 18, 2005

(65) Prior Publication Data

US 2006/0113170 A1 Jun. 1, 2006

(30) Foreign Application Priority Data

Nov. 26, 2004 (FR) ..... 04 52764

(51) Int. Cl.
*H01H 13/70* (2006.01)

(52) U.S. Cl. ..... 200/5 R; 200/6 A

(58) Field of Classification Search ..... 200/5 A, 200/5 R, 6 A, 4, 18, 17 R
See application file for complete search history.

(56) References Cited

U.S. PATENT DOCUMENTS 3,005,055 A 10/1961 Mattke
6,657,141 B1 12/2003 Myojin
7,060,915 B2 * 6/2006 Bricaud et al. ..... 200/5 R
7,102,088 B2 * 9/2006 Tan et al. ..... 200/6 A
2005/0284737 A1 * 12/2005 Shitanaka et al. ..... 200/5 R
2006/0219532 A1 * 10/2006 Tan ..... 200/4

FOREIGN PATENT DOCUMENTS

EP 1 026 713 9/2000
JP 11 031440 2/1999

* cited by examiner

*Primary Examiner*—Elvin Enad
*Assistant Examiner*—Lisa Klaus
(74) *Attorney, Agent, or Firm*—Peter Van Winkle

(57) ABSTRACT

The invention proposes an electrical switch (20) with multiple switching ways comprising a bottom support (22) in the bottom (32) of which are arranged fixed contacts (30*a*, 30*b*, 30*c*, 30*d*), a top member (26) that is mounted to be movable relative to the bottom support (22) from a central rest position to four main actuation positions distributed angularly at 90°, and a contact plate (28) that comprises four contact blades (34) each of which is capable of coming into contact with a fixed contact (30*b*), characterized in that the actuation member (26) is mounted to be movable relative to the support (22) to one or other of four intermediate actuation positions that are offset angularly by 45° relative to the main actuation positions, and in each of which two contact blades (34) are simultaneously in contact with the associated fixed contacts (30*b*).

18 Claims, 5 Drawing Sheets

L
T
42
30b
42
40
22
30c
48
34
39
32
36
60
39
30d
28
34
42
42
30b
A
F1
30b
34
42
42
38
40
30a
40
36
39
60
48
30c
39
40
42
34
30b
42

L
T
30b
42
30c
40
34
39
F2
48
39
60
30a
36
40
34
30d
42
A
30b
30b
42
40
60
42
38
39
36
28
22
34
48
40
31
42
30b
42
30c

ELECTRICAL SWITCH WITH MULTIPLE SWITCHING WAYS

CROSS-REFERENCE

Applicant claims priority from French patent application SN. 0452764 filed Nov. 26, 2004.

BACKGROUND OF THE INVENTION

The invention proposes an electrical switch with several switching ways distributed about a main vertical axis of the actuator.

The invention proposes more particularly an electrical switch with multiple switching ways comprising:

- an insulating bottom support that delimits a housing with a generally vertical main axis (A), and, in the horizontal bottom thereof, fixed electrical contacts are arranged;
- a top actuation member that is mounted to be movable relative to the bottom support from a central rest position, in which it is generally coaxial with the main vertical axis and into which it is elastically returned, to one or other of at least four main actuating positions distributed angularly at 90° about the main vertical axis;
- a contact plate made of an electrically conductive material which extends generally horizontally between the bottom support and the actuation member and which comprises four main contact blades distributed angularly at 90° about the main vertical axis, each of which is capable of coming selectively into contact with an associated main fixed contact of the support, when the actuation member is in an associated main actuation position, to establish an electrical switching way between the associated main fixed contact and a common fixed contact.

Recent developments and the rapid evolution of telecommunications methods, such as portable radio telephones, portable computers and other devices for which the control of various functions envisages, for example, moving a cursor with precision and speed on a screen, require the availability of electromechanical components of increasingly smaller dimensions and, particularly in the aforementioned field, allowing the scanning of menus, the movement of a symbol on a screen and, more generally, the combination of several electrical switching functions in a single component.

It is particularly desirable, in the case of an application with a portable telephone (for example GSM or UMTS) whose dimensions are constantly reducing and which the user must be able to operate and control with a single hand, that such a multiple switch can be operated with a single finger, for example the thumb, being placed on the main front face of the telephone comprising in particular the keypad, or on one of the two main lateral edges of the telephone casing, or under the main face of the telephone.

The need for a control device that is compact and having very small dimensions making it possible to move a cursor on a screen, and/or scroll down menus, also called a browser, is increasingly important on the devices of the "portable telephone" or "personal digital assistant" type offering an increasing number of functions and services requiring in particular choices proposed on one or more screens, similar to the use of a portable computer, or else the portable devices processing sound files digitized for example according to the "MP3" standard.

It is thus desirable to have an electrical switch with multiple switching ways requiring a single actuation member that can be operated with a finger.

Such operations, for example by means of the bottom face of the thumb of the hand that is holding the device, must be easy and be able to be carried out in as many directions as possible, with great user-friendliness and low operating forces (less than 2 Newtons).

In addition, such a miniaturized component must supply its user with a tactile sensation reflecting the validity of the operations performed.

The tactile sensation transmitted by the switch to the user is a very important parameter for its performance and user-friendliness.

The electrical selection pulses are thus produced by "scanning" the space by operations during which the actuation member is moved in different directions relative to a central rest position towards which it is elastically returned when the user relaxes his action on the top operating end.

There are many switches with four actuation positions distributed angularly at 90°.

However, the current electronic apparatus comprise a large number of functions, so that the control of the electronic apparatus using only these four actuation positions may prove particularly difficult.

Thus, to improve the simplicity of the control of the apparatus, it has been proposed to increase the number of actuation positions of the actuation member, by increasing in consequence the number of switching ways of the switch.

However, this increase in the number of switching ways involves an increase in the number of movable contact and fixed contact blades, which results in increasing the volume of the switch.

SUMMARY OF THE INVENTION

The object of the invention is to propose an electronic switch comprising more than four actuation positions.

For this purpose, the invention proposes an electrical switch with multiple switching ways comprising:

- an insulating bottom support with fixed electrical contacts;
- a top actuation member that is movable relative to the bottom support from a central rest position into which it is elastically returned, to one or other of at least four main actuating positions distributed angularly at 90°;
- a contact element which, under the action of said actuation member, is capable of selectively establishing an electrical switching way between one of each fixed contact and a common fixed contact, characterized in that the actuation member is also mounted to be movable relative to the support from its rest position to at least one intermediate actuation position that is offset angularly at 45° relative to two main angularly adjacent actuation positions, and in that, when the actuation member is the said intermediate actuation position, the said contact element simultaneously establishes an electrical switching way between the common fixed contact and the two associated fixed contacts, in order to establish a fifth electrical switching way.

The invention also proposes an electrical switch of the type previously described, characterized in that the actuation member is also mounted to be movable relative to the support from the central rest position to one or other of four intermediate actuation positions that are distributed angularly at 90° around the main vertical axis of the switch and that are offset angularly at 45° relative to the main actuation positions, and in that, when the actuation member is in one of the intermediate actuation positions, the two main contact blades that are associated with the main actuation positions situated either side of the intermediate actuation position are simultaneously in contact with the associated main fixed contacts.

According to other features of the invention:

- the contact plate is fixedly attached to the actuation member in a horizontal sliding movement relative to the bottom support, from the central rest position to one or other of the eight main or intermediate actuation positions;
- the main contact blades extend generally radially towards the outside of the contact plate, relative to the main vertical axis;
- the support comprises a bearing element associated with each contact blade and that protrudes upwards relative to the bottom of the housing and with each of which the free radial end of the associated main contact blade interacts to elastically return the contact plate and the actuation member towards the intermediate rest position;
- each bearing element comprises two ramp-shaped portions facing one another which are arranged generally symmetrically and either side of the main fixed contact associated with the main contact blade associated with the bearing element;
- the electrical switch comprises means for producing a mechanical pulse on the actuation member when the actuation member and the contact plate slide relative to the support from the central rest position to one of the main or intermediate actuation positions;
- the contact plate comprises a series of bosses that are capable of interacting with complementary orifices of an element that is fixed relative to the support to produce the mechanical pulse;
- the orifices are formed in an intermediate plate that is interposed vertically between the actuation member and the contact plate and in that each boss is received in a complementary orifice when the actuation member and the contact plate are in the central rest position, and each boss is capable of coming out of the orifice when the actuation member and the contact plate slide relative to the support, while producing a mechanical pulse;
- the movement of the actuation member towards each of its actuation positions consists in a pivoting of the actuation member about a horizontal pivoting axis associated with the actuation position;
- each main contact blade can be elastically deformed under the action of the actuation member to come into contact with the associated main fixed contact;
- the electrical switch comprises a trigger element that is interposed vertically between each main contact blade and the associated main fixed contact and that can be elastically deformed when the actuation member acts on the main contact blade to electrically connect the main contact blade to the main fixed contact;
- the trigger member is capable of elastically returning the actuation member to the central rest position;
- the trigger element is generally convex, and it is capable of collapsing when the actuation member acts on the main contact blade;
- the trigger element forms a releasable stop of the associated main contact blade, that is capable of collapsing when the amplitude of the action of the actuation member on the associated main contact blade is greater than a predetermined amplitude threshold value;
- the actuation member is mounted to be rotatable relative to the support and relative to the contact plate about the main vertical axis, and the contact plate comprises secondary contact blades on which the actuation member acts during its rotation so that each comes into contact with an associated secondary fixed contact of the support, to electrically connect it to the common fixed contact;
- the actuation member comprises teeth, distributed angularly about the main axis while forming a crown coaxial with the actuation member, that are capable of interacting with the secondary contact blades so that each secondary contact blade comes periodically into contact with the associated secondary fixed contact when the actuation member is rotated;
- the contact plate comprises two secondary contact blades that are offset angularly about the axis of rotation of the actuation member at an acute angle whose value is determined so as to allow the direction of rotation of the actuation member to be determined;
- the electrical switch comprises means for producing a main vertical orientation mechanical pulse on the actuation member when the actuation member is rotated relative to the support;
- the contact plate comprises at least one boss which protrudes upwards relative to a horizontal top face of the contact plate and which is capable of interacting with each of the teeth of the actuation member to produce the mechanical pulses;
- the contact plate comprises at least one connection blade that is permanently in contact with the common fixed contact of the support;
- the electrical switch comprises a central actuator that is arranged coaxially with the actuation member, relative to the main vertical axis and that is mounted to slide axially relative to the actuation member and relative to the support between a top rest position and a bottom position in which it makes the electrical connection between the common fixed contact and a central fixed contact, to establish an associated switching way called the selection way;
- the central actuator acts on a central trigger element to electrically connect the common fixed contact and the central fixed contact;
- the trigger element is generally convex and is capable of collapsing under the action of the central actuator;
- the central trigger element forms a releasable stop of the central actuator that is capable of collapsing when the amplitude of the action of the central actuator is greater than a predetermined amplitude threshold value.

Other features and advantages of the invention will appear on reading the following detailed description for the understanding of which reference should be made to the appended figures.

DESCRIPTION OF THE PREFERRED EMBODIMENTS

To describe the invention, the vertical, longitudinal and transversal orientations will be used in a non-limiting manner according to the V, L, T marking indicated in the figures.

Figure 3:
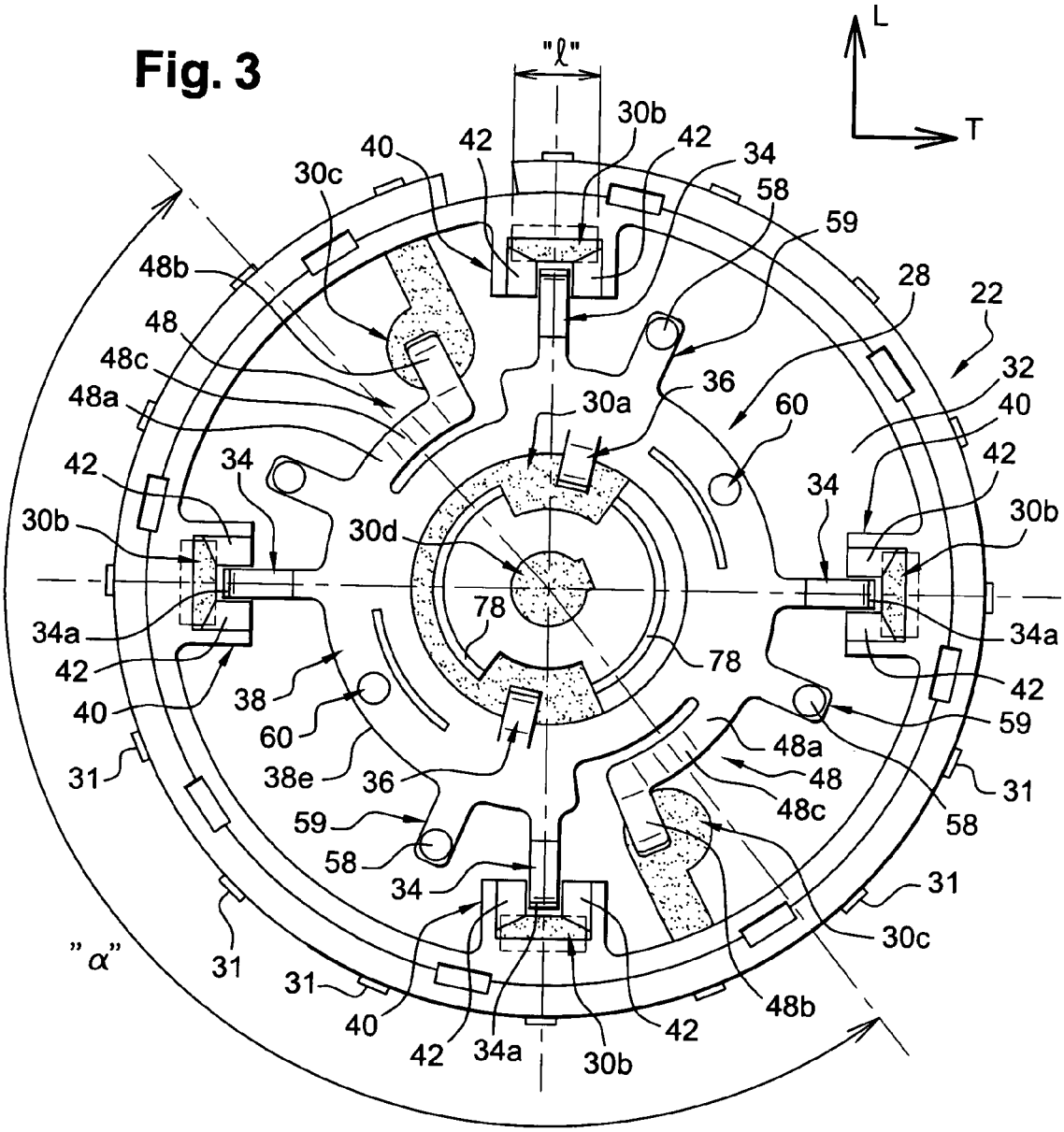
FIG. 3 is a top view of the support, the contact plate and the fixed contacts of the switch according to the invention, in which the contact plate is in its central rest position.

The longitudinal orientation from front to rear will also be adopted as being the longitudinal direction and from top to bottom with reference to FIG. 3, and the transversal orientation from left to right as being the transverse direction from left to right.

In the following description, identical, similar or analogous elements will be indicated by the same reference numbers.

Figure 1:
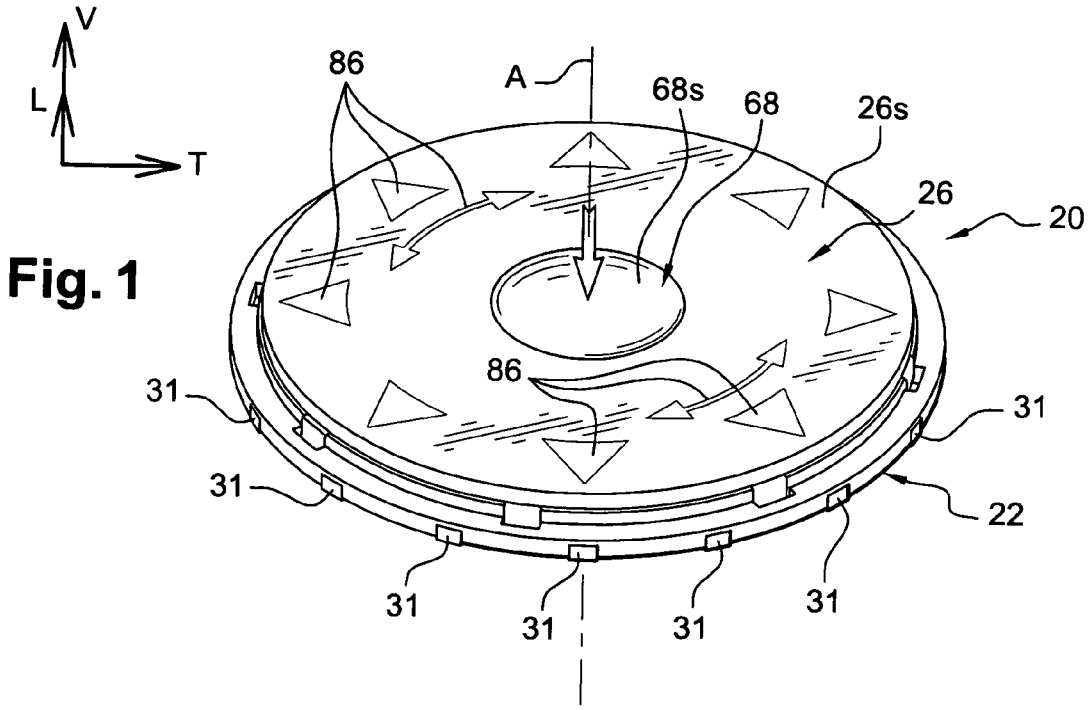
FIG. 1 is a schematic representation in perspective from above of the electrical switch according to the invention.
Figure 2:
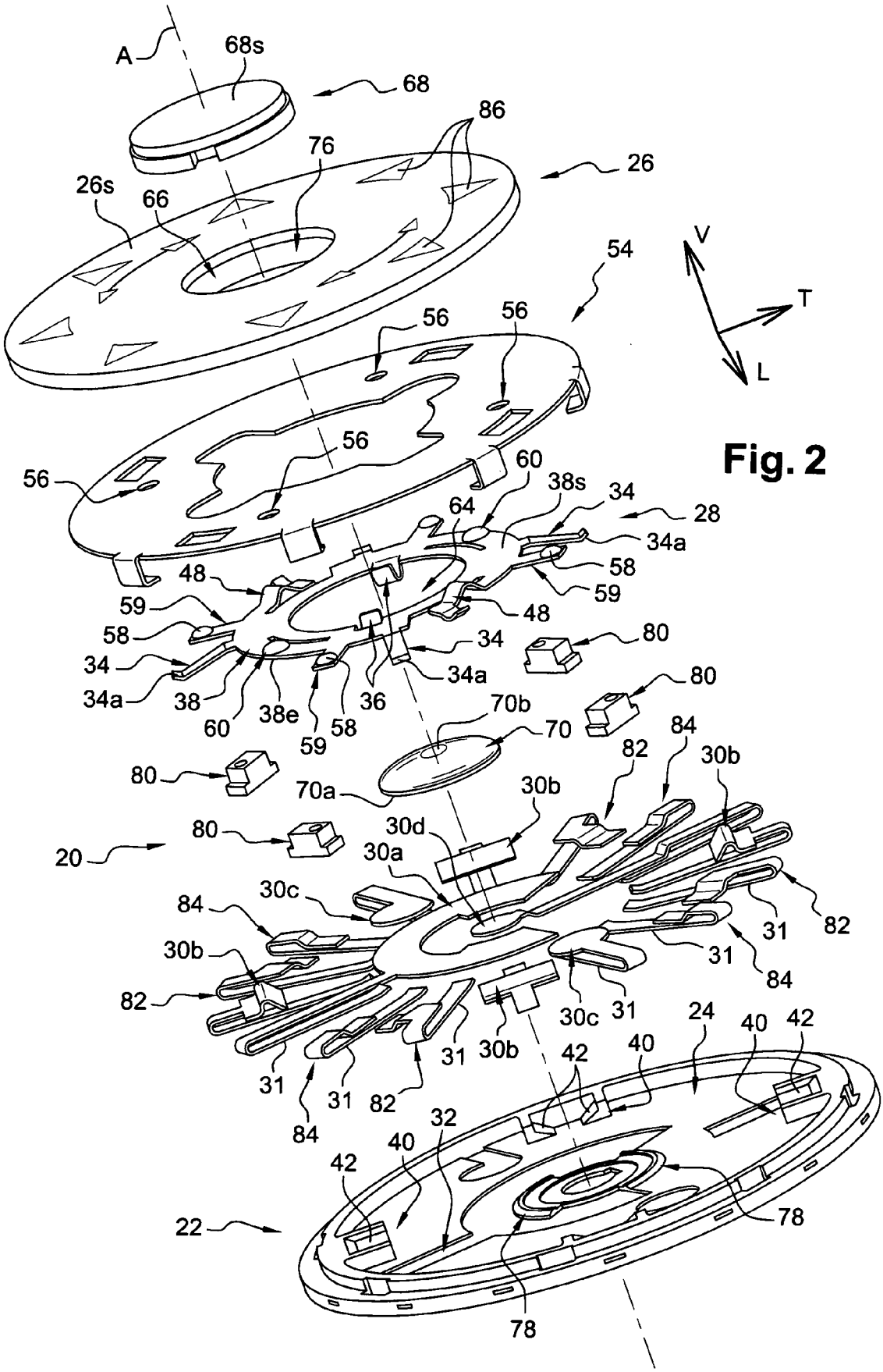
FIG. 2 is a schematic representation in exploded perspective of the switch represented in FIG. 1.

FIGS. 1 and 2 show an electrical switch 20 that has the general shape of a flat disc with a main vertical axis A.

The switch 20 consists of an axial stack comprising, from top to bottom, a top actuation member 26 (or actuator), an intermediate contact plate 28 (FIG. 2) and a bottom support (22).

The support 22 is of circular shape and generally horizontal and it delimits a housing 24 open upwards and having a main vertical axis A.

The bottom 32 of the housing 24 supports a set of fixed electrical contacts 30*a*, 30*b*, 30*c*, 30*d* of which a first fixed contact 30*a* forms a contact common to all the switching ways of the switch 20 and of which each of the other fixed contacts 30*b*, 30*c*, 30*d* is associated with one of the switching ways of the switch 20.

Each of the fixed electrical contacts 30*b*, 30*c* is capable of being electrically and selectively connected to the common fixed contact 30*a* by means of the contact plate 28, so as to establish the associated switching way of the switch 20, for example by soldering or brazing.

The fixed contact 30*d* is capable of being connected to the common fixed contact 30*a* by means of the central trigger element 70 that will be described below.

Each of the fixed contacts 30*a*, 30*b* is made of a piece with a radial connection terminal 31 which extends to the outside of the switch 20, protruding downwards relative to the bottom horizontal face of the support 22.

The connection terminals 31 are used to electrically connect the switch 20 to an electronic control device of the electronic apparatus that is equipped with the switch 20.

Thus, each time one of the switching ways is established, the electronic control device is capable of determining which action the user has just made on the actuation member 26, and it is capable of controlling the operation of the electronic apparatus according to this movement.

Finally, the support 22 is made of an electrically insulating material, for example of plastic, and according to a preferred embodiment of the invention, the support 22 is made by overmoulding around the fixed contacts 30*a*, 30*b*, 30*c*, 30*d*, so as to fixedly attach all the fixed contacts 30*a*, 30*b*, 30*c*, 30*d* to the support 22.

The top actuation member 26 has here the shape of a flat disc coaxial with the main axis A of the switch 20 and it is mounted to be movable relative to the support 22 under the action of the user to control the operation of the switch 20.

When it is moved relative to the support 22, the actuation member 26 acts on the contact plate 28 so that the contact plate 28 electrically connects the common fixed contact 30*a* to one or more other fixed contacts 30*b*, 30*c* associated with this movement.

The contact plate 28 is arranged in the housing 24 of the support 22, between the bottom 32 of the housing 24 and the actuation member.

The contact plate 28 comprises connection blades 36 that are in permanent contact with the common fixed contact 30*a* of the main contact blades 34 each of which is associated with a main fixed contact 30*b*.

When the actuation member 26 is moved relative to the support 22, it acts on the contact plate 28, so that a main contact blade 34 associated with the contact plate 28 is placed in contact with the associated fixed contact 30*b*, so as to make the electrical connection between this main fixed contact 30*b* and the common fixed contact 30*a* thus establishing a switching way of the switch 20.

The actuation member 26 is mounted to be movable relative to the support 22 from a central rest position, represented in FIG. 1, in which it is coaxial with the axis A of the switch, to one or other of four main actuation positions that are distributed angularly at 90° about the main axis A of the switch 20.

Figure 4:
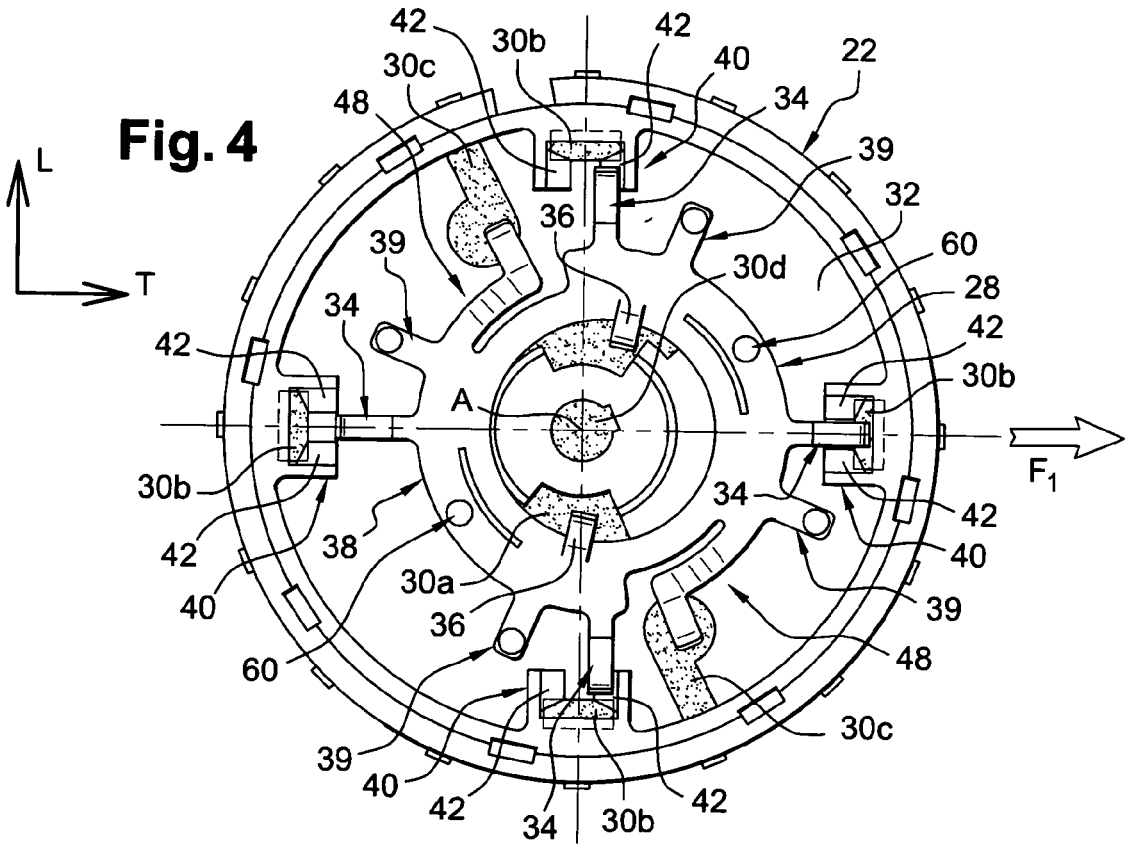
FIG. 4 is a view similar to that of FIG. 3, in which the contact plate is in the main right transversal actuation position.
Figure 5:
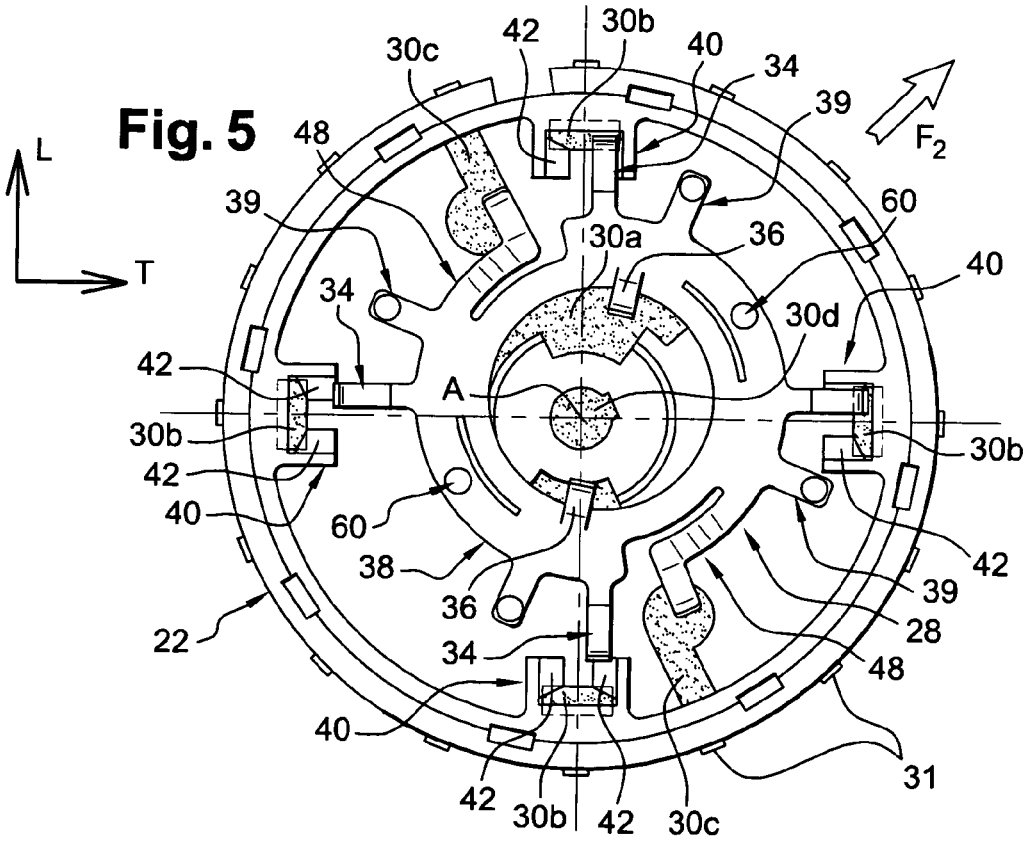
FIG. 5 is a view similar to that of FIG. 3, in which the contact plate is in its top right secondary actuation position.

Here, with reference to FIGS. 3 to 5, the four main actuation positions are situated respectively longitudinally in front, longitudinally behind, transversely to the right and transversely to the left of the central rest position.

The contact plate 28 comprises four main contact blades 34 distributed angularly at 90° about the main axis A, each of which is capable of coming selectively into contact with an associated main fixed contact 30*b*, when the actuation member 26 is moved towards one or other of the four main actuation positions.

Thus, the support 22 supports four main fixed contacts 30*b*, each of which is associated with a main actuation position of the actuation member 26, and consequently the switch 20 comprises four main switching ways each of which is associated with a main actuation position of the actuation member 26.

According to the invention, the actuation member 26 is also mounted to be movable relative to the support 22 from a central rest position to one or other of four intermediate actuation positions.

The intermediate actuation positions are distributed angularly at 90° about the main vertical axis A, and they are offset angularly at an angle of 45° relative to the main actuation positions.

Thus, the actuation member 26 is capable of being moved towards one or other of eight different actuation positions that are distributed angularly at 45° about the main axis A of the switch.

In addition, according to the invention, when the actuation member 26 is in an intermediate actuation position, two main contact blades 34 are simultaneously in contact with the associated main fixed contacts 30*b*.

The two main contact blades 34 that are simultaneously in contact are consecutive angularly about the main axis A, and they are associated with the longitudinal actuation position and with the transverse actuation position that are situated either side of the intermediate actuation position respectively.

For example, when the actuation member 26 is moved towards the front right intermediate actuation position, it is the main contact blades 34 associated with the front longitudinal actuation position and with the right transverse actuation position that are simultaneously in contact with the associated main fixed contacts 30*b*.

Thus, when the actuation member 26 is moved towards an intermediate actuation position, it simultaneously actuates two main contact blades 34 then simultaneously establishing two main switching ways of the switch 20.

The electronic control device of the electronic apparatus fitted with the switch 20 according to the invention is programmed so as to analyse the establishment of the main switching ways, so that the simultaneous establishment of two main switching ways is interpreted as the establishment of a single secondary switching way.

According to a first embodiment of the switch 20 according to the invention, the actuation member 26 and the contact plate 28 are mounted to slide horizontally relative to the support 22.

Thus, the movement of the actuation member 26 from the central rest position to each of the main or intermediate actuation positions consists in a radial sliding of the actuation member 26 and of the contact plate 28 relative to the support 22, in the associated direction.

Figure 6:
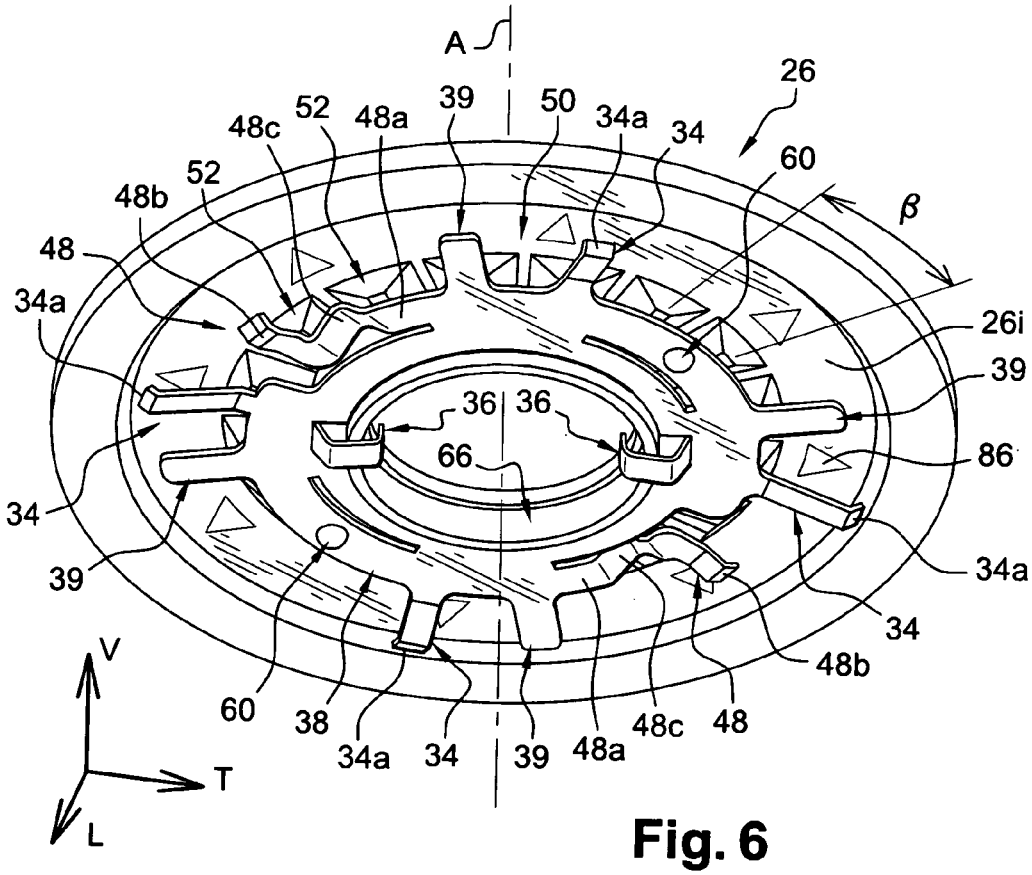
FIG. 6 is a view from below in perspective of the actuation member and of the contact plate, showing the bottom teeth.

As can be seen in FIG. 6, the contact plate 28 comprises a circular-shaped body 38, coaxial with the main axis A, that comprises a central circular hole 64 coaxial with the main axis A in which an annular sleeve 66 complementing the actuation member 26 is received, so as to fixedly attach the contact plate 28 to the actuation member 26 by sliding horizontally.

The main contact blades 34 extend radially towards the outside of the contact plate 28 from the peripheral edge 38*e* of the body 38, in the longitudinal or transverse direction corresponding to the associated main actuation position.

In addition, each main contact blade 34 is capable of coming into contact with the associated main fixed contact 30*b* at its free radial end 34*a*.

Thus, the main contact blade 34 associated with the front longitudinal actuation position extends longitudinally forwards from the outer edge 38*e* of the body 38.

The main fixed contact 30*b* associated with each main contact blade 34 is situated radially opposite and at a distance from the free radial end 34*e* of the contact blade 34.

In addition, the width "I" of each main fixed contact 30*b*, measured tangentially relative to the main associated direction, is determined so that the associated main contact blade 34 can come into contact with the main fixed contact 30*b* irrespective of the main or intermediate actuation position to which the actuation member 26 and the contact plate 28 are moved.

Thus, when the actuation member 26 is moved towards the main right transverse actuation position, as has been shown in FIG. 4 by the arrow F1, the main contact blade 34, which extends radially and transversely rightwards relative to the body 38, comes into contact with the associated main fixed contact 30*b*.

And when the actuation member 26 is moved towards the intermediate front right actuation position, as has been represented in FIG. 5 by the arrow F2, the main contact blade 34, which extends radially and transversely rightwards relative to the body 38, and the main contact blade 34, which extends radially and longitudinally forwards relative to the body 38, come simultaneously into contact with the associated main fixed contacts 30*b*.

According to another aspect of the invention, the switch 20 comprises means making it possible to elastically return the actuation member 26 and the contact blade 28 from one of the main or intermediate actuation positions to the central rest position.

According to a preferred embodiment of this aspect of the invention, the actuation member is elastically returned by means of the main contact blades 34 which are for this purpose capable of being elastically deformed when the actuation member 26 is in a longitudinal, transverse or intermediate actuation position.

For this, the support 22 comprises bearing elements 40 that protrude upwards relative to the bottom 32 of the housing 24 and on which the free radial end 34*a* of each main contact blade 34 is capable of pressing to perform the elastic return.

When the actuation member 26 is in one of the four main actuation positions, it is only the free ends 34*a* of the two main contact blades 34, that are perpendicular to the main contact blade 34 associated with the main actuation position, that are each bearing on an associated bearing element 40.

And when the actuation member is in one of the four intermediate actuation positions, it is the four main contact blades 34 that are bearing on the bearing elements 40.

For example, as has been shown in FIG. 4, when the actuation member 26 is moved towards the main right transverse actuation position, it is the main contact blades 34 that extend radially longitudinally from the body 38 of the contact plate 20 that interact with the associated bearing elements 40.

Conversely, as has been shown in FIG. 5, when the actuation member 26 is moved towards the front right intermediate actuation position, the four main contact blades 34 interact with the bearing elements 40 to achieve the elastic return.

Here, each bearing element 40 comprises two ramp-shaped portions 42 facing one another that are oriented upwards and generally tangentially to the main direction of actuation and that are arranged tangentially and symmetrically either side of the main fixed contact 30*b* associated with the main actuation direction.

When the actuation member 26 is moved towards one of its main or intermediate actuation positions, the free end 34*a* of the main contact blade 34 comes to bear on one of the portions 42, the main contact blade 34 then deforms elastically upwards.

The main contact blade 34 then exerts an elastic force on the ramped portion 42, which tends to return the contact plate 28 towards the central rest position.

Thus, when the user, after having exerted on the actuation member 26 and action to push it towards the actuation position, relaxes his action, the contact plate 28, and the actuation member 26 are returned towards the central rest position under the effect of the elastic return force exerted by the main contact blade 34 on the associated ramp-shaped portion 42.

Figure 7:
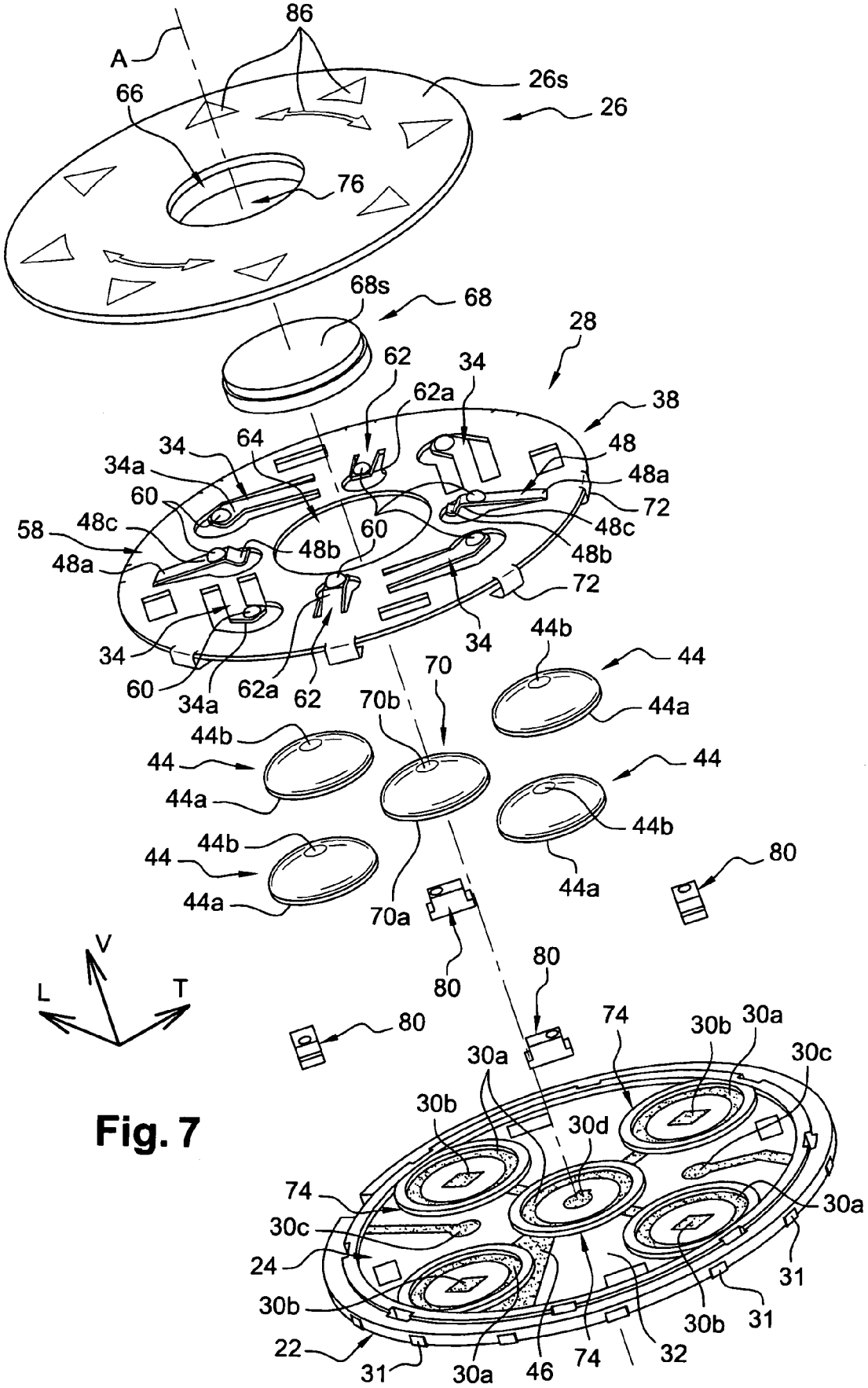
FIG. 7 is a schematic representation in exploded perspective of the switch according to a variant embodiment of the invention.

FIG. 7 shows a second embodiment of the switch 20 according to the invention in which the movement of the actuation member 26 towards each actuation position consists in a pivoting motion relative to the support 22 and relative to the contact plate 28, about a horizontal pivoting axis situated in an axial plane associated with each actuation position.

Each pivoting axis of the actuation member 26 is generally perpendicular to the radial direction corresponding to the associated actuation position.

For example, the pivoting axis of the actuation member 26, when it is moved towards the main actuation position situated longitudinally in front of the central rest position, is parallel to the transverse direction T.

According to this embodiment of the invention, the contact plate 28 is attached to the support 22 by fixing lugs 72, and each main contact blade 34 can be elastically deformed downwards under the action of the actuation member 26 to come into contact with the associated main fixed contact 30*b*.

The main contact blades 34 are produced by cutting and bending in the body 38 of the contact blade 28, and here they extend generally tangentially to the main axis A of the switch 20.

The switch 20 according to this second embodiment of the invention also comprises a trigger member 44 made of electrically conductive material, which is interposed between each main contact blade 34 and the associated main fixed contact 30*b*.

The trigger member 44 is in permanent contact with the common fixed contact 30*a*, and it is capable of deforming elastically, when the actuation member 26 acts on the associated main contact blade 34, to electrically connect the main fixed contact 30*b* associated with the main contact blade 34 to the common fixed contact 30*a*.

Here, the trigger member 44 forms an upward convex dome, whose bottom circular edge 44*a* is bearing on an associated common fixed contact 30*a*, and on whose top 44*b* the free end 34*a* of the associated contact blade 34 bears.

Thus, the bottom 32 of the housing 24 supports several common fixed contacts 30*a*, each of which is of circular shape and is associated with a contact blade 34, the common fixed contacts 30*a* are electrically connected together and to one and the same connection terminal 31 via a conductive track 46.

The support 22 also comprises a circular centring ring 74 associated with each trigger member 44, which extends around the associated common fixed contact 30*a* and which protrudes upwards relative to the bottom 32 of the housing 24.

The trigger member 44 is received in the housing delimited by the centring ring 74 so as to achieve the horizontal positioning of the actuation member 44 on the support 22.

The trigger member 44 is capable of collapsing when the actuation member 26 acts on the associated main contact blade 34, so that its top 44*b* comes into contact with the associated main fixed contact 30*b*, electrically connecting it to the common fixed contact 30*a*.

As has been said above, and according to the invention, the switch 20 comprises four main contact blades 34, each of which is associated with a main actuation position, and four fixed contacts 30*b*, each associated with a main contact blade 34.

Consequently, the switch also comprises four trigger members 44, each of which is associated with a main contact blade 34, that are situated longitudinally in front of or behind the main axis A, or transversely to the left or to the right of the main axis A.

Thus, a single trigger member 44 is acted upon when the actuation member 26 is moved towards one of the main actuation positions, and two trigger members 44 are acted upon simultaneously when the actuation member 26 is moved towards an intermediate actuation position.

As has been said above, it is desirable to have a switch 20 that can be operated by a finger, for example by means of the thumb of the hand that is holding the apparatus.

In addition, the switch 20 must provide the user with a tactile sensation reflecting the validity of the operations made.

For this, and in accordance with another aspect of the invention, the switch 20 comprises means for producing a tactile sensation as feedback from each of the operations that the user exerts on the actuation member 26.

According to the first aspect of the invention in which the actuation member 26 and the contact plate 28 are mounted to be movable by sliding horizontally relative to the support 22, the means for producing a tactile sensation comprise a series of bosses 58 that are capable of interacting with complementary orifices 56.

According to a preferred embodiment, the orifices 56 are made in an intermediate plate 54 that is arranged between the contact plate 28 and the actuation member 26, and that is attached to the support 22, and the bosses 58 are supported by the contact plate 28 so that they protrude upwards relative to the top horizontal face of the contact plate 28.

Each boss 58 is received in an associated orifice 56 when the contact plate 28 and the actuation member 26 are in the central rest position, and it is capable of coming out of the associated orifice when the user exerts on the actuation member 26 a pushing action, towards one of the actuation positions, whose amplitude is greater than a predefined amplitude threshold value.

Thus, the bosses 58 associated with the complementary housings 56 form a stop, to the horizontal sliding of the actuation member 26 and the contact plate 28, which can be released under the action of the user.

In addition, when the actuation member 26 is in the central rest position, the bosses 58 can be used to centre the actuation member 26 relative to the support 22.

Thus, when the user acts on the actuation member 26 to move it towards one of the actuation positions, and the amplitude of his action is less than the amplitude threshold value, the bosses 58 and the associated orifices 56 prevent the contact plate 28 and the actuation member 26 from moving relative to the support 22; the user then senses a resistance to the movement of the actuation member 26.

Conversely, when the user acts on the actuation member 26 while increasing the amplitude of his action, he causes the bosses 58 to come out of the orifices 56, then releasing the contact plate 28 and the actuation member 26 which can consequently slide horizontally relative to the support 22 and relative to the intermediate plate 54 towards the desired actuation position.

The user then senses this movement of the actuation member 26 and of the contact plate 28 as a pulse on the actuation member 26.

Here, each boss 58 is made at the free radial end of a lug 59 which extends radially towards the outside of the contact plate 28 from the peripheral edge of the body 38.

Here, the contact plate 28 comprises a series of four bosses 58, distributed annularly at 90° about the main axis A, and the intermediate plate 54 also comprises a series of four orifices 56.

The radial blades 59 are capable of deforming elastically downwards when the user exerts an action of an amplitude greater than the amplitude threshold value, so that the bosses 58 retract downwards to come out of the orifices 56.

According to the second aspect of the invention represented in FIG. 7, the tactile sensation is produced by each of the trigger members 44 which is acted upon when the actuation member 26 is moved towards one of the actuation positions.

Accordingly, each trigger member 44 forms a stop of the main associated contact blade 34 that can be released in a downward movement, and that is capable of changing state, here by collapsing, when the amplitude of the action of the actuation member 26 on the associated main contact blade 34 is greater than a predetermined threshold value.

The change of state of the trigger member 44 by collapsing is relatively sudden; it is used to produce a tactile sensation that is similar to that produced by a keypad button for example.

According to another aspect of the switch 20 according to the invention, the actuation member 26 is mounted to rotate, relative to the support 22 and relative to the contact plate 28, about the main axis A of the switch.

The contact plate 28 comprises secondary contact blades 48 on which the actuation member 26 acts when it rotates, and each of which is capable of coming selectively into contact with an associated secondary fixed contact 30*c* when the actuation member 26 rotates.

As can be seen in FIG. 6, the actuation member 26 comprises a series of teeth 52 which protrude downwards relative to the bottom horizontal face 26*i* of the actuation member 26, and which are distributed angularly at regular intervals about the main axis A while forming a crenelated crown 50 coaxial with the main axis A.

The teeth 52 are capable of interacting successively with each of the secondary contact blades 48 when the actuation member 26 rotates so that the switching way associated with each secondary fixed contact 30*c* is established intermittently.

Each secondary contact blade 48 comprises a section 48*a* for connection to the body 38 of the contact plate 28, a section 48*b* for contact with the associated secondary fixed contact 30*c*, and an intermediate section 48*c* with which the teeth 52 interact to cause the secondary contact blade 48 to make contact with the associated secondary fixed contact 30*c*.

The intermediate section 48*c* of the secondary contact blade 48 protrudes upwards relative to the body 38 of the contact plate 28 and is curved upwards.

Each establishment of the switching way associated with each secondary fixed contact is perceived by the electronic control device of the electronic apparatus as an electronic pulse.

In addition, the electronic control device is designed so as to determine the angle of rotation of the actuation member 26 and its speed of rotation relative to the support 22, about the main axis A.

For example, two consecutive pulses that originate from one and the same switching way associated with a secondary fixed contact 30*c*, correspond to the fact that two consecutive teeth 52 have successively interacted with the secondary contact blade 48 and therefore that the actuation member 26 has pivoted through an angle equal to the value of the angle "α" of angular offset between two consecutive teeth (FIG. 6).

Thus, by counting the number of consecutive pulses, the electronic control device is capable of determining the angle of rotation of the actuation member 26.

In addition, by measuring the time period between two pulses, that is to say the frequency of these pulses, the electronic control device is capable of determining the speed of rotation of the actuation member 26.

However, the frequency of these pulses does not make it possible to determine the direction of rotation of the actuation member 26 relative to the support 22.

For this, as can be seen in FIG. 3, the contact plate 28 comprises two secondary contact blades 48 that are offset angularly from one another about the main axis A, at an acute angle "α"—measured at the top of the intermediate section 48*c* of each secondary contact blade 48—whose value is determined so that the frequency of the pulses associated with switching ways associated with the secondary fixed contacts 30*c* is out of phase one with the other, without being in opposite phase.

It is then possible to determine the direction of rotation of the actuation member 26 as a function of the phase delay or phase advance of one switching way relative to the other.

Thus, according to the invention, the value of the angle "α" differs by a multiple of half the value of the angle "α" of annular offset of two consecutive teeth 52.

This gives the mathematical expression:

$$\alpha \neq k\left(\frac{\beta}{2}\right)$$

where k is a natural non-zero whole number.

According to a variant embodiment of the invention, the switch 20 comprises means for producing a mechanical pulse on the actuation member 26 during its rotation relative to the support.

Accordingly, the contact plate 28 comprises bosses 60 that protrude upwards relative to the top horizontal face 38*s* of the body 38 of the contact plate 28 and that are situated radially perpendicular to the teeth 52 of the crown 50.

The height of each boss 60 is determined so that the teeth 52 of the crown 50 strike successively against the bosses 60 when the actuation member 26 is rotated, then producing mechanical pulses on the actuation member 26.

According to a variant embodiment of these means for producing the mechanical pulses, and according to the second aspect of the invention represented in FIG. 7, each boss 60 is arranged at the free end 48*a* of each secondary contact blade 48 and at the free end 62*a* of additional radial blades 62 of the contact plate 28.

According to yet another aspect of the invention, the switch 20 comprises a central axial-action member 68 that is arranged coaxially with the main axis A.

The actuation member 26 comprises a cylindrical central housing 76 into which the central member 68 is guided in a sliding axial movement.

The central member 68 is movable relative to the support 22 and relative to the actuation member 26 from a top rest position represented in the figures, to which it is returned elastically and in which its top horizontal face 68*s* is flush with the top horizontal face 26*s* of the actuation member 26, towards a bottom actuation position in which it acts on a central trigger element 70 to establish the electrical connection between the common fixed contact 30*a* and a central fixed contact 30*d*.

The switch 20 then comprises another switching way that is established when the common fixed contact 30*a* and the central fixed contact 30*d* are electrically connected.

The central member 68 is usually actuated to perform a validation function of the electronic apparatus. The switching way associated with the central member 68 is then called the selection way.

The central trigger element 70 forms a convex dome curved upwards and is made of electrically conductive material.

The circular peripheral edge 70*a* of the central trigger member 70 is in permanent contact with the common fixed contact 30*a* and the top 70*b* of the central trigger member 70 is situated beneath and at a distance from the central fixed contact 30*d*.

Thus, when the user acts on the central member 68, he causes the trigger element 70 to collapse so that its top 70*b* comes into contact with the central fixed contact 30*d*.

According to a variant embodiment of the central trigger member 70, the latter forms a stop of the central member 68 that can be released in a downward movement, and it is capable of changing state, here by collapsing, when the amplitude of the user's action on the central member 68 is greater than a predetermined threshold value.

The tactile sensation thus produced by the central trigger member 70 is similar to that produced by a keypad button.

In addition, the bottom 32 of the support 22 comprises means of horizontally positioning the central trigger member 70, so that it is coaxial with the main axis A.

According to the first embodiment of the invention, the horizontal positioning means consist of ribs 78 that protrude upwards relative to the bottom 32 and that are each in the form of an arc of a circle centred on the main axis, between which the central trigger member 70 is received.

According to the second embodiment of the invention represented in FIG. 7, the positioning means comprise a circular centring ring 74 that is centred on the main axis A, and the trigger member 44 is arranged in the housing delimited by this centring ring 74.

Finally, the switch 20 comprises illumination means 80 making it possible to see in particular the actuation member 26 when the conditions of visibility are reduced, particularly when the ambient light is inadequate.

These illumination means 80 here consist in light-emitting diodes, or LEDs, that are arranged in the housing 24 delimited by the support 22, and each of which is electrically powered by an associated anode 82 and cathode 84.

The actuation member 26 comprises a series of translucent portions 86 through which the light originating from the diodes 80 is capable of travelling.

In addition, so that the switch 20 has a pleasing appearance, the translucent portions 86 are in the form of arrows each of which is associated with a movement of the actuation member relative to the support 22.

Thus, as can be seen in the figures, eight translucent portions 86 are distributed angularly at 45° about the main axis A and have the shape of arrows oriented radially towards the outside of the switch 20, and are each associated with the main or intermediate actuation positions of the actuation member 26.

In addition, two translucent portions 86 form arrows curved in an arc of a circle centred on the main axis A, and are associated with the rotation of the actuation member 26 about the main axis A.

According to an other embodiment, not illustrated, the actuation member or actuator 26 can be made in the form of an elastically deformable plate or member having a fixed central position and on which the user may apply an effort on several areas or zones to deform it locally to act for instance on one or several blades.

What is claimed is:

1. Electrical switch (20) with multiple switching ways comprising an insulating bottom support (22) that forms a housing (24) with a generally vertical main axis (A), a plurality of electrical contacts lying on said insulating bottom support (22) including at least one common electrical contact (30*a*) and a plurality of selectable electrical contacts (30*b*, 30*c*, 30*d*), a top actuation member (26) that is mounted to be movable relative to the insulating bottom support (22) from a central rest position, in which it is generally coaxial with the vertical main axis (A) and into which it is elastically returned, to one or other of at least four main actuating positions distributed angularly at 90° about the vertical main axis (A), a contact plate (28) made of an electrically conductive material which extends generally horizontally between the bottom support and the actuation member (26) and which comprises four main contact blades (34) distributed angularly at 90° about the vertical main axis, each of which is capable of coming selectively into contact with a selected one of said selectable electrical contacts (30*b*), when the actuation member (26) is in an associated main actuation position, to establish an electrical switching way between the selected selectable electrical contact (30*b*) and said common fixed contact (30*a*), each of said main contact blades (34) extending generally radially towards an outside of the contact plate (28), relative to the vertical main axis, wherein:

the actuation member (26) is also mounted to be movable relative to the bottom support (22) from the central rest position to one or other of four intermediate actuation positions that are distributed angularly at 90° around the vertical main axis (A) of the switch (20) and that are offset angularly at 45° relative to the main actuation positions;

when the actuation member (26) is in one of the intermediate actuation positions, the two main contact blades (34) that are associated with the main actuation positions and that are situated on either side of said one of the intermediate actuation positions are simultaneously in contact with the associated main fixed contacts (30*b*);

said support comprises a bearing element (40) that is associated with each contact blade and that protrudes upwards relative to the bottom (32) of the housing (24), with a free radial end (34*a*) of an associated main contact blade (34) interacting with a bearing element (40) to elastically return the contact plate (28) and the actuation member (26) towards the intermediate rest position.

2. Electrical switch (20) according to claim 1, characterized in that:

each bearing element comprises two ramp-shaped portions (42) facing one another which are arranged generally symmetrically and either side of the main fixed contact (30*b*) associated with the main contact blade (34) associated with the bearing element.

3. Electrical switch (20) with multiple switching ways comprising an insulating bottom support (22) that forms a housing (24) with a generally vertical main axis (A), a plurality of electrical contacts (30*a*, 30*b*, 30*c*, 30*d*) on a horizontal bottom of said housing, a top actuation member (26) that is mounted to be movable relative to the insulating bottom support (22) from a central rest position, in which it is generally coaxial with the vertical main axis (A) and into which it is elastically returned, to one or other of at least four main actuating positions distributed angularly at 90° about the vertical main axis (A), a contact plate (28) made of an electrically conductive material which extends generally horizontally between the bottom support and the actuation member (26) and which comprises four main contact blades (34) distributed angularly at 90° about the main vertical axis, each of which is capable of coming selectively into contact with an associated main fixed contact (30*b*) on the insulating bottom support (22), when the actuation member (26) is in an associated main actuation position, to establish an electrical switching way between the associated main fixed contact (30*b*) and a common fixed contact (30*a*), wherein:

an actuation member (26)is also mounted to be movable relative to the insulating bottom support (22) from the central rest position to one or other of four intermediate actuation positions that are distributed angularly at 90° around the main vertical axis (A) of the switch (20) and that are offset angularly at 45° relative to the main actuation positions;

when the actuation member (26) is in one of the intermediate actuation positions, the two main contact blades (34) that are associated with the main actuation positions situated on either side of the intermediate actuation position are simultaneously in contact with the associated main fixed contacts (30*b*); and the contact plate (28) comprises a series of bosses (58) that are capable of interacting with complementary orifices (56) of an element (54) that is fixed relative to the support (22) to produce a mechanical pulse.

4. Electrical switch (20) according to claim 3, characterized in that the orifices (56) are formed in an intermediate plate (54) that is interposed vertically between the actuation member (26) and the contact plate (28) and in that each boss (58) is received in a complementary orifice (56) when the actuation member (26) and the contact plate (28) are in the central rest position, and each boss (58) is capable of coming out of the orifice (56) when the actuation member (26) and the contact plate (28) slide relative to the support (22), while producing a mechanical pulse.

5. Electrical switch (20) with multiple switching ways comprising an insulating bottom support (22) that forms a housing (24) with a generally vertical main axis (A) and, in a horizontal bottom thereof, fixed electrical contacts (30*a*, 30*b*, 30*c*, 30*d*) are arranged, the electrical switch including a top actuation member (26) that is mounted to be movable relative to the bottom support (22) from a central rest position in which it is generally coaxial with the main vertical axis (A) and into which it is elastically returned, to one or other of at least four main actuating positions distributed angularly at 90° about the vertical main axis (A), a contact plate (28) made of an electrically conductive material which extends generally horizontally between the bottom support and the actuation member (26) and which comprises four main contact blades (34) distributed angularly at 90° about the main vertical axis, each of which is capable of coming selectively into contact with an associated main fixed contact (30*b*) of the insulating bottom support (22), when the actuation member (26) is in an associated main actuation position, to establish an electrical switching way between the associated main fixed contact (30*b*) and a common fixed contact (30*a*), wherein:

the actuation member (26) is also mounted to be movable relative to the insulating bottom support (22) from the central rest position to one or other of four intermediate actuation positions that are distributed angularly at 90° around the main vertical axis (A) of the switch (20) and that are offset angularly at 45° relative to the main actuation positions;

when the actuation member (26) is in one of the intermediate actuation positions, the two main contact blades (34) that acre associated with the main actuation positions situated either side of the intermediate actuation position are simultaneously in contact with the associated main fixed contacts (30*b*);

the actuation member (26) is mounted to be rotatable relative to the support (22) and relative to the contact plate (28) about the main vertical axis (A), and the contact plate (28) comprises secondary contact blades (48) on which the actuation member (26) acts during its rotation so that each secondary contact blade comes into contact with an associated secondary fixed contact (30*c*) of the insulating bottom support (22), to electrically connect it to the common fixed contact (30*a*).

6. Electrical switch (20) according to claim 5, characterized in that the actuation member (26) comprises teeth (52), distributed angularly about the main axis (A) while forming a crown (50) coaxial with the actuation member (26), that are capable of interacting with the secondary contact blades (48) so that each secondary contact blade (48) comes periodically into contact with the associated secondary fixed contact (30*c*) when the actuation member (26) is rotated.

7. Electrical switch (20) according to claim 5, characterized in that the contact plate (28) comprises two secondary contact blades (48) that are offset angularly about the axis (A) of rotation of the actuation member (26) at an acute angle ($\alpha$) whose value is determined so as to allow the direction of rotation of the actuation member (26) to be determined.

8. Electrical switch (20) according to claim 5, characterized in that it comprises means (60) for producing a main vertical orientation mechanical pulse on the actuation member (26) when the actuation member (26) is rotated relative to the support (22).

9. Electrical switch (20) according to claim 8, characterized in that the contact plate (28) comprises at least one boss (60) which protrudes upwards relative to a horizontal top face (28*s*) of the contact plate (28) and which is capable of interacting with each of the teeth (52) of the actuation member (26) to produce the mechanism pulses.

10. Electrical switch (20) with multiple switching ways comprising an insulating bottom support (22) that forms a housing (24) with a generally vertical main axis (A) and, in the insulating bottom support, fixed electrical contacts (30*a*, 30*b*, 30*c*, 30*d*) are arranged, said electrical switch including a top actuation member (26) that is mounted to be movable relative to the insulating bottom support (22) from a central rest position, in which it is generally coaxial with the vertical main axis (A) and into which it is elastically returned, to one or other of at least four main actuating positions distributed angularly at 90° about the main vertical axis (A), a contact plate (28) made of an electrically conductive material which extends generally horizontally between the bottom support and an actuation member (26) and which comprises four main contact blades (34) distributed angularly at 90° about the main vertical axis, each of which is capable of coming selectively into contact: with an associated main fixed contact (30*b*) of the support (22), when the actuation member (26) is in an associated main actuation position, to establish an electrical switching way between the associated main fixed contact (30*b*) and a common fixed contact (30*a*), wherein:

the actuation member (26) is also mounted to be movable relative to the support (22) from the central rest position to one or other of four intermediate actuation positions that are distributed angularly at 90° around the vertical main axis (A) of the switch (20) and that are offset angularly at 45° relative to the main actuation positions;

when the actuation member (26) is in one of the intermediate actuation positions, the two main contact blades (34) that are associated with the main actuation positions situated either side of the intermediate actuation position are simultaneously in contact with the associated main fixed contacts (30*b*);

the contact plate (28) comprises at least one connection blade (36) that is permanently in contact with the common fixed contact (30*a*) of the insulating bottom support (32).

11. Electrical switch (20) according to claim 10, characterized in that it comprises a central actuator (68) that is arranged coaxially with the actuation member (26), relative to the:main vertical axis (A) and that is mounted to slide axially relative to the actuation member (26) and relative to the support (22) between a 1 top rest position and a bottom position in which it makes the electric connection between the common fixed contact (30*a*) and a central fixed contact (30*d*), to establish an associated switching way called the selection way.

12. Electrical switch. (20) according to claim 10, characterized in that the central actuator (68) acts on a central trigger element (70) to electrically connect the common fixed contact (30*a*) and the central fixed contact (30*d*).

13. Electrical switch (20) according to claim 12, characterized in that the central trigger element (70) forms a releasable stop of the central actuator (68) that is capable of collapsing when the amplitude of the action of the central actuator (68) is greater than a predetermined amplitude threshold value.

14. Electrical switch (20) according to claim 10, characterized in that the trigger element (70) is generally convex and is capable of collapsing under the action of the central actuator (68).

15. An electrical switch (20) with multiple switching ways comprising:

an insulating bottom support (22) with fixed electrical contacts (30*a*, 30*b*, 30*c*, 30*d*) lying in a plane;

a top actuation member (26) that is movable relative to the insulating bottom support (22) from a central rest position into which it is elastically returned, to one or other of at least four main actuating positions distributed angularly at 90°;

a contact element (28) which is coupled to said top actuation member to move with it, said contact element being capable of selectively establishing an electrical switching way between one of each fixed contact (30*b*) and a common fixed contact (30*a*), the top actuation member (26) being mounted to be movable relative to the insulating bottom support (22) from its rest position to at least one intermediate actuation position that is offset angularly at 45° relative to two main angularly adjacent actuation positions and when the top actuation member (26) is in said intermediate actuation position, the said contact element (28) simultaneously establishes an electrical switching way between the common fixed contact (30*a*) and the two associated fixed contacts, in order to establish a fifth electrical switching way;

the movement of said actuation member is in sliding movement parallel said plane.

16. The electrical switch described in claim 15 wherein:

said support comprises a bearing element associated with each of a plurality of said contact blades, that biases each of said plurality of blades to slide the blade toward its rest position.

17. Electrical switch (20) with multiple switching ways comprising:

an insulating bottom support (22) that forms a housing (24) with a generally vertical main axis (A), and, in the horizontal bottom thereof, fixed electrical contacts (30*a*, 30*b*, 30*c*, 30*d*) lying in a plane;

a top actuation member (26) that is mounted to be movable relative to the bottom support (22), from a central rest position in which it is generally coaxial with the main vertical axis (A), and into which it is elastically returned, to one or other of at least four main actuating positions distributed angularly at 90° about the main vertical axis (A);

a contact plate (28) made of an electrically conductive material which extends generally horizontally between the bottom support and the actuation member (26) and which comprises four main contact blades (34) distributed angularly at 90° about the main vertical axis, each of which is capable of coming selectively into contact with an associated main fixed contact (30*b*) of the insulating bottom support (22), when the actuation member (26) is in an associated main actuation position, to establish an electrical switching way between the associated main fixed contact (30*b*) and a common fixed contact (30*a*);

the actuation member (26) is also mounted to be movable relative to the support (22) from the central rest position to one or other of four intermediate actuation positions that are distributed angularly at 90° around the main vertical axis (A) of the switch (20) and that are offset angularly at 45° relative to the main actuation positions;

when the actuation member (26) is in one of the intermediate actuation positions, the two main contact blades (34) that are associated with the main actuation positions situated either side of the intermediate actuation position are simultaneously in contact with the associated main fixed contacts (30*b*);

the movement of said actuation member is in sliding movement parallel to said plane.

18. The electrical switch described in claim 17 wherein:

said support comprises a bearing element associated with each of a plurality of said contact blades to slide the blade towards its rest position.

* * * * *